US011696604B2

(12) United States Patent
Henry, Jr. et al.

(10) Patent No.: US 11,696,604 B2
(45) Date of Patent: Jul. 11, 2023

(54) AEROSOL DELIVERY DEVICE AND RELATED METHOD AND COMPUTER PROGRAM PRODUCT FOR CONTROLLING AN AEROSOL DELIVERY DEVICE BASED ON INPUT CHARACTERISTICS

(71) Applicant: R.J. Reynolds Tobacco Company, Winston-Salem, NC (US)

(72) Inventors: Raymond Charles Henry, Jr., Cary, NC (US); Frederic Philippe Ampolini, Winston-Salem, NC (US)

(73) Assignee: RAI STRATEGIC HOLDINGS, INC., Winston-Salem, NC (US)

( * ) Notice: Subject to any disclaimer, the term of this patent is extended or adjusted under 35 U.S.C. 154(b) by 962 days.

(21) Appl. No.: 14/209,191

(22) Filed: Mar. 13, 2014

(65) Prior Publication Data

US 2015/0257445 A1 Sep. 17, 2015

(51) Int. Cl.

| | |
|---|---|
| ***A24F 40/50*** | (2020.01) |
| ***A24F 40/53*** | (2020.01) |
| *A24F 40/10* | (2020.01) |
| *A24F 40/60* | (2020.01) |

(52) U.S. Cl.

CPC ..... *A24F 40/50* (2020.01); *A24F 40/53* (2020.01); *A24F 40/10* (2020.01); *A24F 40/60* (2020.01)

(58) Field of Classification Search

CPC ..... A61M 15/06; A61M 15/05; A24F 47/002; A24F 47/004; A24F 47/006; A24F 47/008; A24F 40/50

See application file for complete search history.

(56) References Cited

U.S. PATENT DOCUMENTS

| | | | |
|---|---|---|---|
| 1,771,366 | A | 7/1930 | Wyss et al. |
| 2,057,353 | A | 10/1936 | Whittemore, Jr. |
| 2,104,266 | A | 1/1938 | McCormick |
| 2,805,669 | A | 9/1957 | Meriro |
| 3,200,819 | A | 8/1965 | Gilbert |
| 3,316,919 | A | 5/1967 | Green et al. |

(Continued)

FOREIGN PATENT DOCUMENTS

| | | |
|---|---|---|
| AU | 276250 | 7/1965 |
| CA | 2 641 869 | 5/2010 |

(Continued)

OTHER PUBLICATIONS

International Search Report and Written Opinion dated Jan. 26, 2016 for Application No. PCT/US2015/019932.

(Continued)

*Primary Examiner* — Anthony Calandra

(74) *Attorney, Agent, or Firm* — Womble Bond Dickinson (US) LLP

(57) ABSTRACT

The present disclosure relates to an aerosol delivery device and related methods and computer program products for controlling an aerosol delivery device based on input characteristics. For example, a method may include an aerosol delivery device determining a characteristic of a user input to the aerosol delivery device. The method may further include the aerosol delivery device determining a control function having a defined association with the characteristic. The method may additionally include the aerosol delivery device performing the control function in response to the user input.

14 Claims, 7 Drawing Sheets

(56) References Cited

U.S. PATENT DOCUMENTS 3,398,754 A 8/1968 Tughan
3,419,015 A 12/1968 Wochnowski
3,424,171 A 1/1969 Rooker
3,476,118 A 11/1969 Luttich
4,054,145 A 10/1977 Berndt et al.
4,131,117 A 12/1978 Kite et al.
4,150,677 A 4/1979 Osborne
4,190,046 A 2/1980 Virag
4,219,032 A 8/1980 Tabatznik et al.
4,259,970 A 4/1981 Green, Jr.
4,284,089 A 8/1981 Ray
4,303,083 A 12/1981 Burruss, Jr.
4,449,541 A 5/1984 Mavs et al.
4,506,682 A 3/1985 Muller
4,635,651 A 1/1987 Jacobs
4,674,519 A 6/1987 Keritsis et al.
4,708,151 A 11/1987 Shelar
4,714,082 A 12/1987 Banerjee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,853,854 A 8/1989 Baher et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A 4/1990 Potter et al.
4,917,119 A 4/1990 Potter et al.
4,917,128 A 4/1990 Clearman et al.
4,922,901 A 5/1990 Brooks et al.
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,042,510 A 8/1991 Curtiss et al.
5,056,537 A 10/1991 Brown et al.
5,060,669 A 10/1991 White et al.
5,060,671 A 10/1991 Counts et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,144,296 A 8/1992 Counts et al.
5,143,097 A 9/1992 Sohn et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,339,838 A 8/1994 Young et al.
5,345,951 A 9/1994 Serrano et al.
5,353,813 A 10/1994 Deevi et al.
5,357,913 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,515,842 A 5/1996 Ramseyer et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,611,360 A 3/1997 Tang
5,613,504 A 3/1997 Collins et al.
5,613,505 A 3/1997 Campbell et al.
5,649,552 A 7/1997 Cho et al.
5,649,554 A 7/1997 Sprinkel et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,687,746 A 11/1997 Rose et al.
5,692,525 A 12/1997 Counts et al.
5,692,526 A 12/1997 Adams et al.
5,708,258 A 1/1998 Counts et al.
5,711,320 A 1/1998 Martin
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.

(56) References Cited

U.S. PATENT DOCUMENTS 5,894,841 A 4/1999 Voges
5,915,387 A 7/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Baggett, Jr. et al.
6,033,623 A 3/2000 Deevi et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,164,287 A 12/2000 White
6,182,670 B1 2/2001 White
6,196,218 B1 3/2001 Voges
6,196,219 B1 3/2001 Hess et al.
6,216,706 B1 4/2001 Kumar et al.
6,289,898 B1 9/2001 Fournier et al.
6,349,729 B1 2/2002 Pham
6,357,671 B1 3/2002 Cewers
6,418,938 B1 7/2002 Fleischhauer et al.
6,446,426 B1 8/2002 Sweeney et al.
6,532,965 B1 3/2003 Abhulimen et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,701,936 B2 3/2004 Shafer et al.
6,715,494 B1 4/2004 McCoy
6,730,832 B1 5/2004 Dominguez et al.
6,772,756 B2 8/2004 Shayan
6,803,545 B2 10/2004 Blake et al.
6,803,550 B2 10/2004 Sharpe et al.
6,810,883 B2 11/2004 Felter et al.
6,854,461 B2 2/2005 Nichols
6,854,470 B1 2/2005 Pu
6,994,096 B2 2/2006 Rostami et al.
7,011,096 B2 3/2006 Li et al.
7,017,585 B2 3/2006 Li et al.
7,025,066 B2 4/2006 Lawson et al.
7,117,867 B2 10/2006 Cox et al.
7,163,015 B2 1/2007 Moffitt
7,173,322 B2 2/2007 Cox et al.
7,185,659 B2 3/2007 Sharpe et al.
7,234,470 B2 6/2007 Yang
7,290,549 B2 11/2007 Banerjee et al.
7,293,565 B2 11/2007 Griffin et al.
7,392,809 B2 7/2008 Larson et al.
7,513,253 B2 4/2009 Kobayashi et al.
7,647,932 B2 1/2010 Cantrell et al.
7,690,385 B2 4/2010 Moffitt
7,692,123 B2 4/2010 Baba et al.
7,726,320 B2 6/2010 Robinson et al.
7,775,459 B2 8/2010 Martens, III et al.
7,810,505 B2 10/2010 Yang
7,832,410 B2 11/2010 Hon
7,845,359 B2 12/2010 Montaser
7,878,209 B2 2/2011 Newbery et al.
7,896,006 B2 3/2011 Hamano et al.
8,066,010 B2 11/2011 Newbery et al.
8,079,371 B2 12/2011 Robinson et al.
8,127,772 B2 3/2012 Montaser
8,156,944 B2 4/2012 Han
8,314,591 B2 11/2012 Terry et al.
8,365,742 B2 2/2013 Hon
8,375,957 B2 2/2013 Hon
8,393,331 B2 3/2013 Hon
8,402,976 B2 3/2013 Fernando et al.
8,499,766 B1 8/2013 Newton
8,528,569 B1 9/2013 Newton
8,550,069 B2 10/2013 Alelov
2002/0146242 A1 10/2002 Vieira
2003/0131859 A1 7/2003 Li et al.
2003/0226837 A1 12/2003 Blake et al.
2004/0020500 A1 2/2004 Wrenn et al.
2004/0118401 A1 6/2004 Smith et al.
2004/0129280 A1 7/2004 Woodson et al.
2004/0149296 A1 8/2004 Rostami et al.
2004/0200488 A1 10/2004 Felter et al.
2004/0226568 A1 11/2004 Takeuchi et al.
2004/0255965 A1 12/2004 Perfetti et al.
2005/0016549 A1 1/2005 Banerjee et al.
2005/0016550 A1 1/2005 Katase
2005/0066986 A1 3/2005 Nestor et al.
2005/0172976 A1 8/2005 Newman
2005/0274390 A1 12/2005 Banerjee et al.
2006/0016453 A1 1/2006 Kim
2006/0070633 A1 4/2006 Rostami et al.
2006/0162733 A1 7/2006 McGrath et al.
2006/0185687 A1 8/2006 Hearn et al.
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2007/0283972 A1 12/2007 Monsees et al.
2008/0085103 A1 4/2008 Beland et al.
2008/0092912 A1 4/2008 Robinson et al.
2008/0149118 A1 6/2008 Oglesby et al.
2008/0245377 A1 10/2008 Marshall et al.
2008/0257367 A1 10/2008 Paterno et al.
2008/0276947 A1 11/2008 Martzel
2008/0302374 A1 12/2008 Wengert et al.
2009/0065010 A1 3/2009 Shands
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0260641 A1 10/2009 Monsees et al.
2009/0260642 A1 10/2009 Monsees et al.
2009/0272379 A1 11/2009 Thorens et al.
2009/0283103 A1 11/2009 Nielsen et al.
2009/0293892 A1 12/2009 Williams et al.
2009/0320863 A1 12/2009 Fernando et al.
2009/0324206 A1 12/2009 Young et al.
2010/0006113 A1 1/2010 Urtsev et al.
2010/0024834 A1 2/2010 Oglesby et al.
2010/0043809 A1 2/2010 Magnon
2010/0059070 A1 3/2010 Potter et al.
2010/0059073 A1 3/2010 Hoffmann et al.
2010/0065075 A1 3/2010 Banerjee et al.
2010/0083959 A1 4/2010 Siller
2010/0163063 A1 7/2010 Fernando et al.
2010/0200006 A1 8/2010 Robinson et al.
2010/0229881 A1 9/2010 Hearn
2010/0242974 A1 9/2010 Pan
2010/0242976 A1 9/2010 Katayama et al.
2010/0258139 A1 10/2010 Onishi et al.
2010/0300467 A1 12/2010 Kuistilla et al.
2010/0307518 A1 12/2010 Wang
2010/0313901 A1 12/2010 Fernando et al.
2011/0005535 A1 1/2011 Xiu
2011/0011396 A1 1/2011 Fang
2011/0036346 A1* 2/2011 Cohen ..... A61M 15/0065 128/200.14
2011/0036363 A1 2/2011 Urtsev et al.
2011/0036365 A1 2/2011 Chong et al.
2011/0073121 A1 3/2011 Levin et al.
2011/0088707 A1 4/2011 Hajaligol
2011/0094523 A1 4/2011 Thorens et al.
2011/0120480 A1 5/2011 Brenneise
2011/0126847 A1 6/2011 Zuber et al.
2011/0126848 A1 6/2011 Zuber et al.
2011/0155153 A1 6/2011 Thorens et al.
2011/0155718 A1 6/2011 Greim et al.
2011/0162663 A1 7/2011 Bryman
2011/0168194 A1 7/2011 Hon
2011/0180082 A1 7/2011 Banerjee et al.
2011/0265806 A1 11/2011 Alarcon et al.

(56) References Cited

U.S. PATENT DOCUMENTS

| | | | | |
|---|---|---|---|---|
| 2011/0290248 | A1* | 12/2011 | Schennum | 128/202.21 |
| 2011/0309157 | A1 | 12/2011 | Yang et al. | |
| 2012/0042885 | A1 | 2/2012 | Stone et al. | |
| 2012/0048266 | A1 | 3/2012 | Alelov | |
| 2012/0060853 | A1 | 3/2012 | Robinson et al. | |
| 2012/0111347 | A1 | 5/2012 | Hon | |
| 2012/0132643 | A1 | 5/2012 | Choi et al. | |
| 2012/0227752 | A1 | 9/2012 | Alelov | |
| 2012/0231464 | A1 | 9/2012 | Yu et al. | |
| 2012/0260927 | A1 | 10/2012 | Liu | |
| 2012/0279512 | A1 | 11/2012 | Hon | |
| 2012/0291791 | A1 | 11/2012 | Pradeep | |
| 2012/0318882 | A1 | 12/2012 | Abehasera | |
| 2013/0037041 | A1 | 2/2013 | Worm et al. | |
| 2013/0042865 | A1 | 2/2013 | Monsees et al. | |
| 2013/0056013 | A1 | 3/2013 | Terry et al. | |
| 2013/0081625 | A1 | 4/2013 | Rustad et al. | |
| 2013/0081642 | A1 | 4/2013 | Safari | |
| 2013/0192615 | A1 | 8/2013 | Tucker et al. | |
| 2013/0192619 | A1 | 8/2013 | Tucker et al. | |
| 2013/0284192 | A1 | 10/2013 | Peleg et al. | |
| 2013/0298905 | A1* | 11/2013 | Levin | A24F 47/008 128/202.21 |
| 2013/0306084 | A1* | 11/2013 | Flick | A24F 47/008 131/328 |
| 2013/0319439 | A1 | 12/2013 | Gorelick et al. | |
| 2013/0340750 | A1 | 12/2013 | Thorens et al. | |
| 2013/0340775 | A1 | 12/2013 | Juster et al. | |
| 2014/0060554 | A1 | 3/2014 | Collett et al. | |
| 2014/0060555 | A1 | 3/2014 | Chang et al. | |
| 2014/0096781 | A1 | 4/2014 | Sears et al. | |
| 2014/0096782 | A1 | 4/2014 | Ampolini et al. | |
| 2015/0078735 | A1* | 3/2015 | Cormack | A61M 15/06 392/395 |
| 2015/0257448 | A1* | 9/2015 | Lord | A24F 47/008 700/90 |

FOREIGN PATENT DOCUMENTS

| | | | |
|---|---|---|---|
| CA | 2 752 255 | | 8/2010 |
| CA | 2818076 | A1 * | 6/2012 |
| CN | 1541577 | | 11/2004 |
| CN | 2719043 | | 8/2005 |
| CN | 200997909 | | 1/2008 |
| CN | 101116542 | | 2/2008 |
| CN | 101176805 | | 5/2008 |
| CN | 201379072 | | 1/2010 |
| CN | 202722503 | | 2/2013 |
| CN | 103338663 | | 10/2013 |
| DE | 10 2006 004 484 | | 8/2007 |
| DE | 102006041042 | | 3/2008 |
| DE | 20 2009 010 400 | | 11/2009 |
| DE | 20 2012 101 880 | | 7/2012 |
| EP | 0 295 122 | | 12/1988 |
| EP | 0 430 566 | | 6/1991 |
| EP | 0 516 293 | | 5/1992 |
| EP | 0 845 220 | | 6/1998 |
| EP | 1 618 803 | | 1/2006 |
| EP | 2 316 286 | | 5/2011 |
| EP | 2 468 116 | | 6/2012 |
| EP | 2 915 443 | A1 | 9/2015 |
| EP | 3542656 | | 2/2022 |
| GB | 1444461 | | 7/1976 |
| GB | 2469850 | | 11/2010 |
| JP | 05212100 | | 8/1993 |
| JP | 1133097 | | 2/1999 |
| JP | 2006505281 | | 2/2006 |
| JP | 3160708 | U | 6/2010 |
| JP | 2013545474 | | 12/2013 |
| WO | WO 1986/02528 | | 5/1986 |
| WO | WO 1997/48293 | | 12/1997 |
| WO | WO 02/37990 | | 5/2002 |
| WO | WO 2004/043175 | | 5/2004 |
| WO | WO 2005/099494 | | 10/2005 |
| WO | WO 2007/078273 | | 7/2007 |
| WO | WO 2007/131449 | | 11/2007 |
| WO | WO 2009/105919 | | 9/2009 |
| WO | WO 2009/155734 | | 12/2009 |
| WO | WO 2010/003480 | | 1/2010 |
| WO | WO 2010/045670 | | 4/2010 |
| WO | WO 2010/073122 | | 4/2010 |
| WO | WO 2010/091593 | | 8/2010 |
| WO | WO 2010/118644 | | 10/2010 |
| WO | WO 2010/140937 | | 12/2010 |
| WO | WO 2011/010334 | | 1/2011 |
| WO | WO 2011/081558 | | 7/2011 |
| WO | 2012027350 | | 3/2012 |
| WO | WO 2012/072762 | | 6/2012 |
| WO | 2012/109371 | | 8/2012 |
| WO | WO 2012/100523 | | 8/2012 |
| WO | 2013/025921 | A1 | 2/2013 |
| WO | 2013/093469 | A2 | 6/2013 |
| WO | WO 2013/089551 | | 6/2013 |
| WO | 2013060784 | A2 | 7/2013 |
| WO | 2013098398 | A2 | 7/2013 |
| WO | 2014/060268 | | 4/2014 |
| WO | WO 2014/060269 | | 4/2014 |
| WO | 2015/028814 | A1 | 3/2015 |
| WO | WO 2015/138589 | | 9/2015 |

OTHER PUBLICATIONS

Chinese Office Action dated Jul. 24, 2018 in corresponding Chinese Application No. 201580023937.3.

Third Party Observation in the corresponding European Patent Application No. 15712234.2, dated Feb. 18, 2021.

Notice of Opposition to a European Patent in the corresponding European Patent Application No. 19173879.8, dated Nov. 9, 2022.

Notice of Opposition to a European Patent in the corresponding European Patent No. 3542656, dated Nov. 9, 2022.

Communication of a Notice of Opposition in the corresponding European Patent Application No. 19173879.8, dated Nov. 16, 2022.

Communication of a Notice of Opposition in the corresponding European Patent Application No. 19173879.8, dated Nov. 18, 2022.

Communication of Further Notices of Opposition in the corresponding European Patent Application No. 19173879.8, dated Nov. 23, 2022.

Office Action dated Jan. 3, 2023, in corresponding Chinese Patent Application No. 202010749919.6.

* cited by examiner

AEROSOL DELIVERY DEVICE AND RELATED METHOD AND COMPUTER PROGRAM PRODUCT FOR CONTROLLING AN AEROSOL DELIVERY DEVICE BASED ON INPUT CHARACTERISTICS

FIELD OF THE DISCLOSURE

The present disclosure relates to aerosol delivery devices such as smoking articles, and more particularly to an aerosol delivery device and related methods and computer program products for controlling an aerosol delivery device based at least in part on input characteristics. The smoking articles may be configured to heat a material, which may be made or derived from tobacco or otherwise incorporate tobacco, to form an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. Pat. U.S. App. Pub. No. 2013/0255702 to Griffith, Jr. et al., U.S. Pat. App. Pub. No. 2014/0000638 to Sebastian et al., U.S. Pat. App. Pub. No. 2014/0060554 to Collett et al., and U.S. patent application Ser. No. 13/647,000, filed Oct. 8, 2012, which are incorporated herein by reference.

Ongoing developments in the field of aerosol delivery devices have resulted in increasingly sophisticated aerosol delivery devices. However, due to factors such as form factor, many aerosol delivery devices have relatively limited user interface mechanisms via which control inputs may be provided by a user. As such, the provision of control inputs to control various device functions and settings continues to be problematic.

SUMMARY OF THE DISCLOSURE

The present disclosure relates to an aerosol delivery device and related methods and computer program products for controlling an aerosol delivery device based at least in part on input characteristics. For example, in one aspect, a method for controlling an aerosol delivery device based at least in part on user input characteristics is provided. The method may include the aerosol delivery device determining a characteristic of a user input to the aerosol delivery device. The method may further include the aerosol delivery device determining a control function having a defined association with the characteristic. The method may additionally include the aerosol delivery device performing the control function in response to the user input.

In another aspect, an aerosol delivery device is provided, which may include processing circuitry. The processing circuitry may be configured to cause the aerosol delivery device to at least determine a characteristic of a user input to the aerosol delivery device; determine a control function having a defined association with the characteristic; and perform the control function in response to the user input.

In a further aspect, a computer program product is provided, which may include at least one non-transitory computer-readable storage medium having program instructions stored thereon. The stored program instructions may include program code for determining a characteristic of a user input to the aerosol delivery device. The stored program instructions may further include program instructions for determining a control function having a defined association with the characteristic. The stored program instructions may additionally include program instructions for performing the control function in response to the user input.

In an additional aspect, a method for controlling an aerosol delivery device based at least in part on characteristics of a puff input is provided. The method may include the aerosol delivery device determining a characteristic of a puff input to the aerosol delivery device. The method may further include the aerosol delivery device determining a control function having a defined association with the characteristic. The method may additionally include the aerosol delivery device performing the control function in response to the puff input.

In still a further aspect, an aerosol delivery device, which may include a puff sensor and processing circuitry coupled with the puff sensor, is provided. The puff sensor may be configured to detect a puff input to the aerosol delivery device. The processing circuitry may be configured to cause the aerosol delivery device to at least determine a characteristic of the puff input; determine a control function having a defined association with the characteristic; and perform the control function in response to the puff input.

In another aspect, a computer program product is provided, which may include at least one non-transitory computer-readable storage medium having program instructions stored thereon. The stored program instructions may include program code for determining a characteristic of a puff input to the aerosol delivery device. The stored program instructions may further include program instructions for determining a control function having a defined association with the characteristic. The stored program instructions may additionally include program instructions for performing the control function in response to the puff input.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages will become apparent from the following detailed description taken in conjunction with the accompanying drawings which illustrate, by way of example, the principles of some described embodiments.

BRIEF DESCRIPTION OF THE FIGURES

Figure 1:
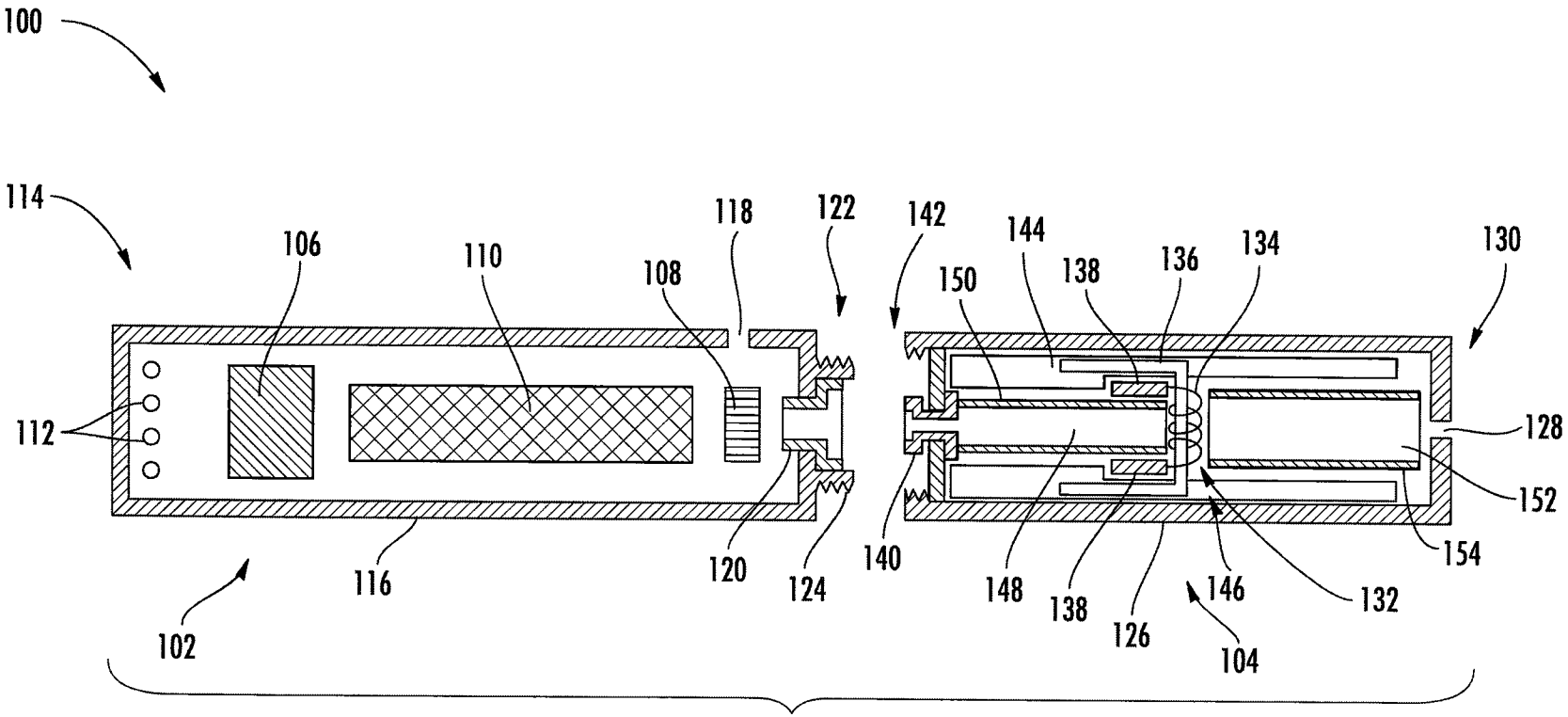
Figure 2:
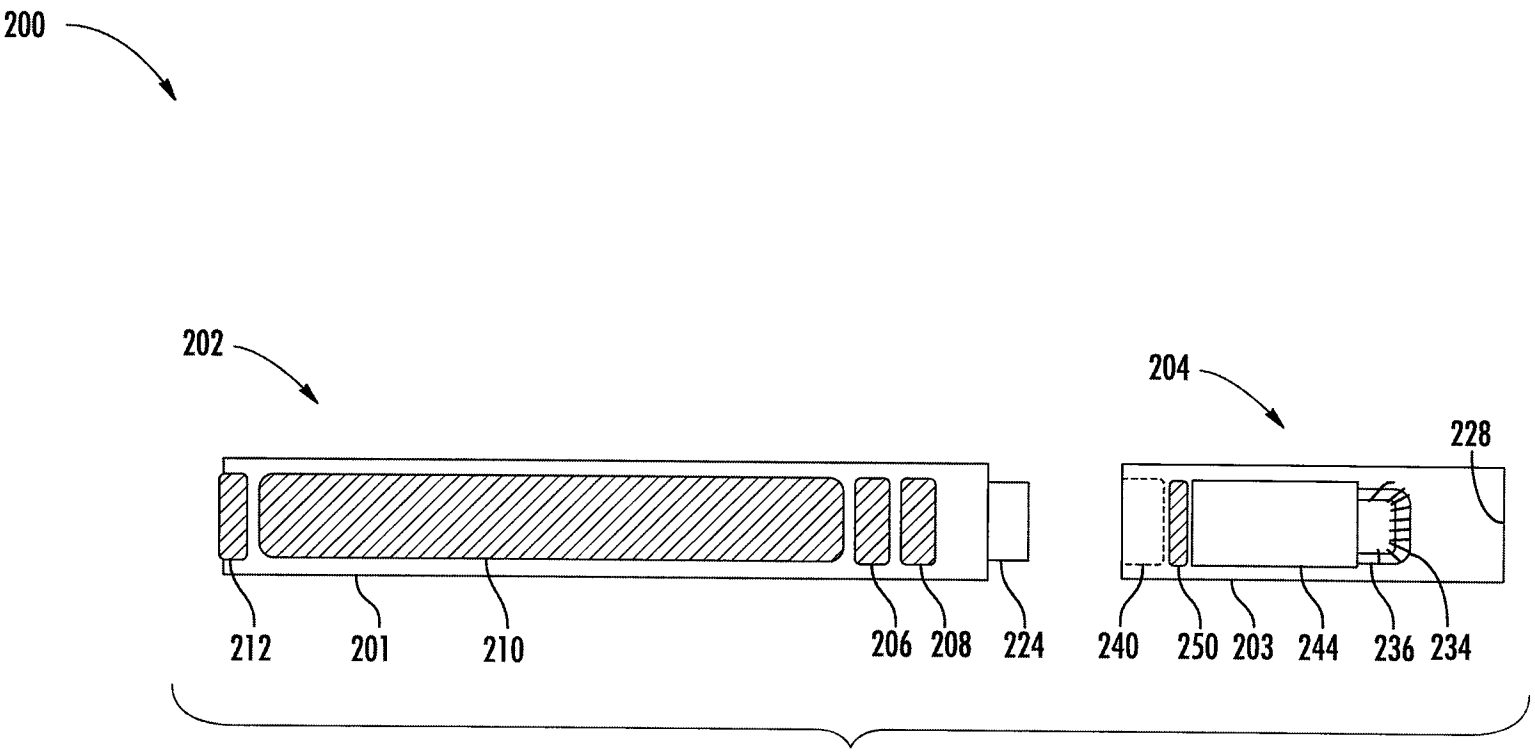
Figure 3:
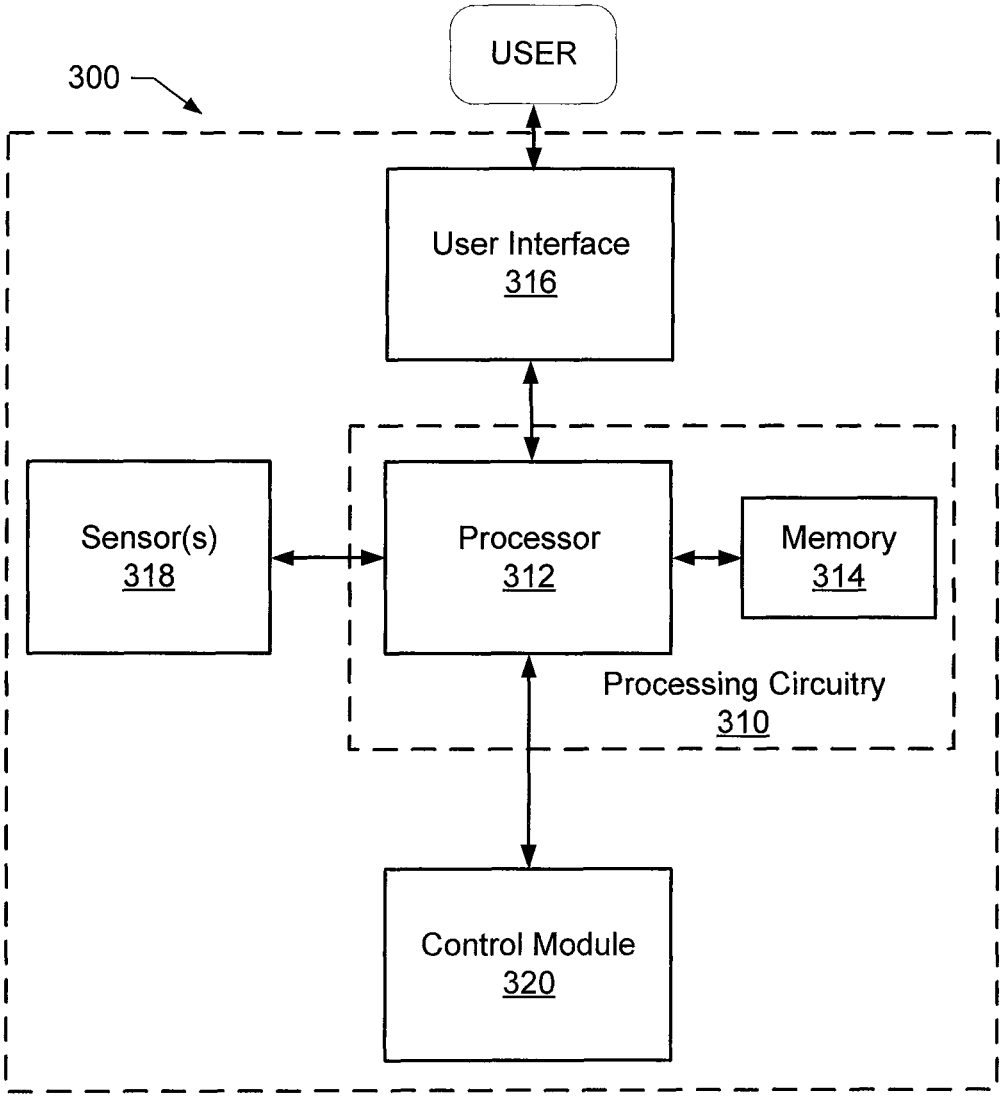
Figure 4:
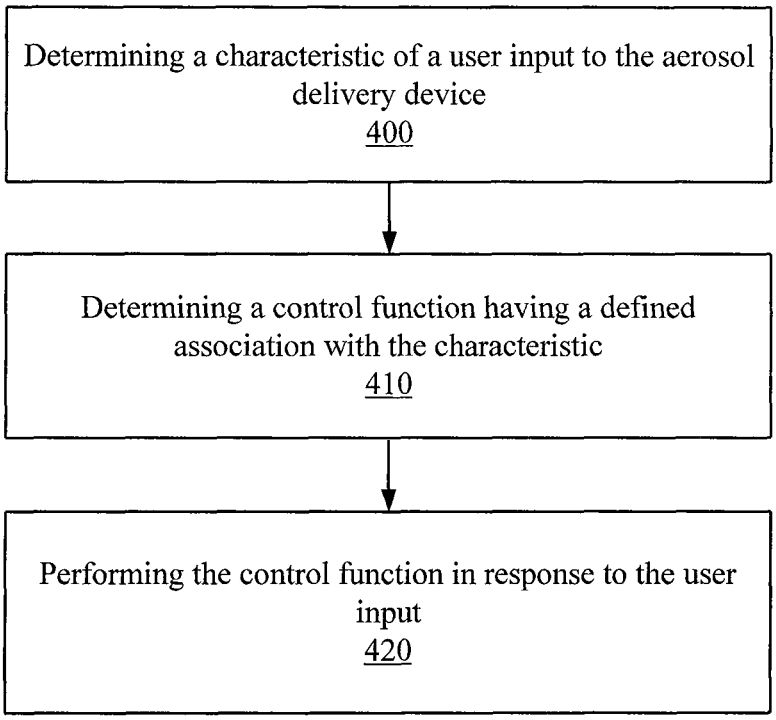
Figure 5:
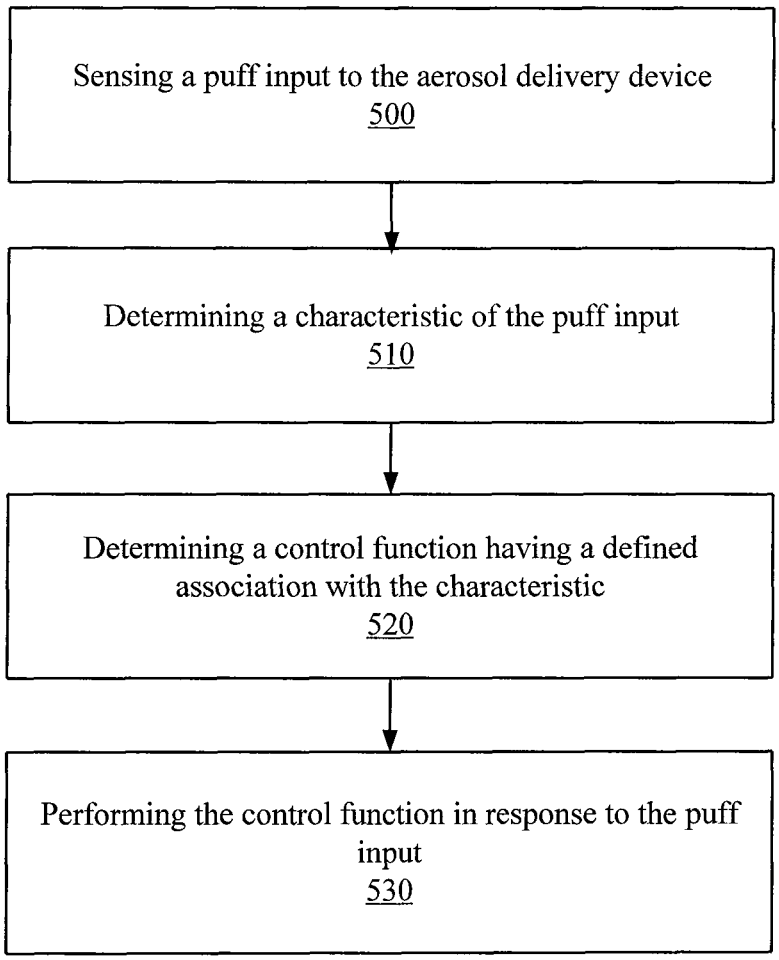
Figure 6:
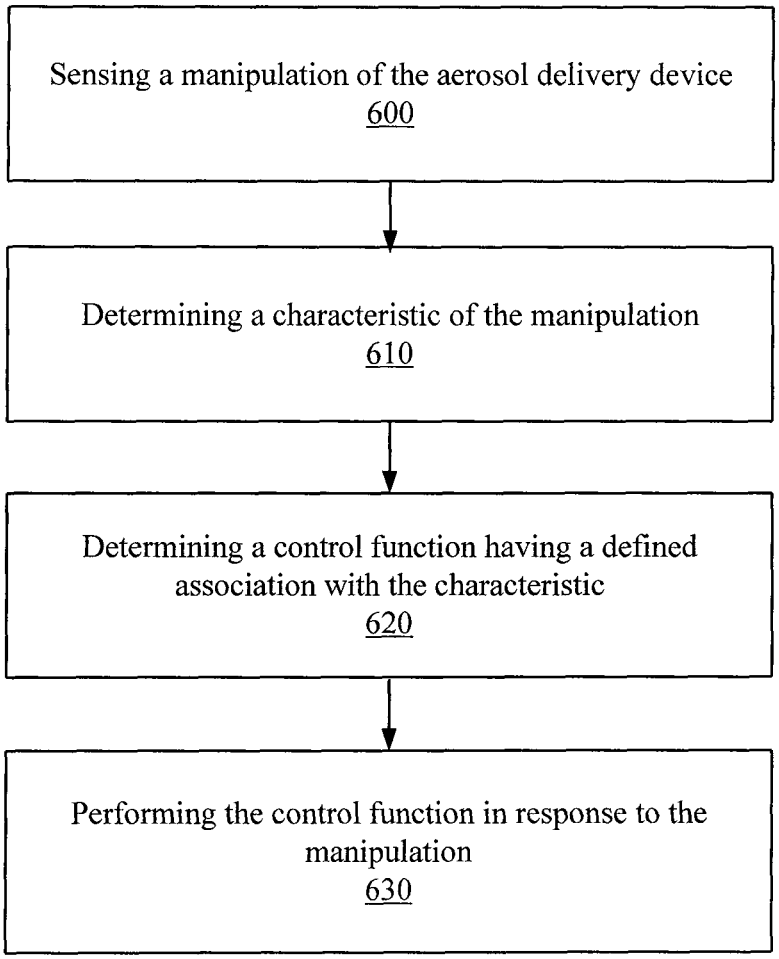
Figure 7:
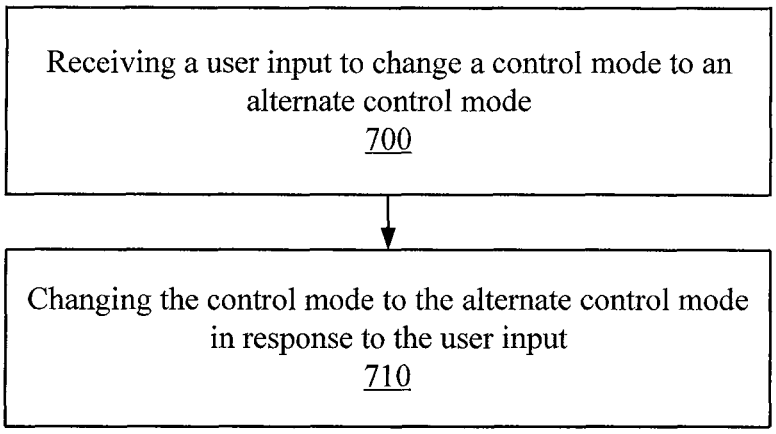

Having thus described the disclosure in the foregoing general terms, reference will now be made to the accompanying drawings, which are not necessarily drawn to scale, and wherein:

FIG. 1 is a sectional view through an electronic smoking article comprising a control body and a cartridge according to an example embodiment of the present disclosure;

FIG. 2 is a sectional view through an electronic smoking article comprising a cartridge and a control body and including a reservoir housing according to an example embodiment of the present disclosure;

FIG. 3 illustrates a block diagram of an apparatus that may be implemented on an aerosol delivery device in accordance with some example embodiments of the present disclosure;

FIG. 4 illustrates a flowchart according to an example method for controlling an aerosol delivery device based at least in part on input characteristics in accordance with some example embodiments of the present disclosure;

FIG. 5 illustrates a flowchart according to an example method for controlling an aerosol delivery device based at least in part on characteristics of a puff input in accordance with some example embodiments of the present disclosure;

FIG. 6 illustrates a flowchart according to an example method for controlling an aerosol delivery device based at least in part on characteristics of a manipulation of the aerosol delivery device in accordance with some example embodiments of the present disclosure; and FIG. 7 illustrates a flowchart according to an example method for changing a control mode for an aerosol delivery device in accordance with some example embodiments of the present disclosure.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

Some example embodiments of the present disclosure relate to an aerosol delivery device and related methods and computer program products for controlling an aerosol delivery device based at least in part on input characteristics. Aerosol delivery devices (e.g., smoking articles) that may be used with various example embodiments may, by way of non-limiting example, include so-called "e-cigarettes." It should be understood that the mechanisms, components, features, and methods associated with such aerosol delivery devices may be embodied in many different forms and associated with a variety of articles.

In this regard, the present disclosure provides descriptions of aerosol delivery devices that use electrical energy to heat a material (preferably without combusting the material to any significant degree) to form an inhalable substance; such articles most preferably being sufficiently compact to be considered "hand-held" devices. An aerosol delivery device may provide some or all of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article or device. The aerosol delivery device may not produce smoke in the sense of the aerosol resulting from by-products of combustion or pyrolysis of tobacco, but rather, that the article or device may yield vapors (including vapors within aerosols that can be considered to be visible aerosols that might be considered to be described as smoke-like) resulting from volatilization or vaporization of certain components of the article or device. In highly preferred embodiments, aerosol delivery devices may incorporate tobacco and/or components derived from tobacco.

Aerosol delivery devices of the present disclosure also can be characterized as being vapor-producing articles, smoking articles, or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, aerosol delivery devices of the present disclosure may be subjected to many of the physical actions employed by an individual in using a traditional type of smoking article (e.g., a cigarette, cigar or pipe that is employed by lighting and inhaling tobacco). For example, the user of an aerosol delivery device of the present disclosure can hold that article much like a traditional type of smoking article, draw on one end of that article for inhalation of aerosol produced by that article, take puffs at selected intervals of time, etc.

Aerosol delivery devices of the present disclosure generally include a number of components provided within an outer body or shell. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary shell; or the elongated body can be formed of two or more separable pieces. For example, an aerosol delivery device can comprise an elongated shell or body that can be substantially tubular in shape and, as such, resemble the shape of a conventional cigarette or cigar. In one embodiment, all of the components of the aerosol delivery device are contained within one outer body or shell. Alternatively, an aerosol delivery device can comprise two or more shells that are joined and are separable. For example, an aerosol delivery device can possess at one end a control body comprising an outer body or shell containing one or more reusable components (e.g., a rechargeable battery and various electronics for controlling the operation of that article), and at the other end and removably attached thereto an outer body or shell containing a disposable portion (e.g., a disposable flavor-containing cartridge). More specific formats, configurations and arrangements of components within the single shell type of unit or within a multi-piece separable shell type of unit will be evident in light of the further disclosure provided herein. Additionally, various aerosol delivery device designs and component arrangements can be appreciated upon consideration of the commercially available electronic aerosol delivery devices, such as those representative products listed in the background art section of the present disclosure.

Aerosol delivery devices of the present disclosure most preferably comprise some combination of a power source (e.g., an electrical power source), at least one control component (e.g., means for actuating, controlling, regulating and ceasing power for heat generation, such as by controlling electrical current flow the power source to other components of the article—e.g., a microcontroller), a heater or heat generation component (e.g., an electrical resistance heating element or component commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined air flow path through the article such that aerosol generated can be withdrawn therefrom upon draw). Exemplary formulations for aerosol precursor materials that may be used according to the present disclosure are described in U.S. Pat. Pub. No. 2013/0008457 to Zheng et al., the disclosure of which is incorporated herein by reference in its entirety.

Alignment of the components within the aerosol delivery device can vary. In specific embodiments, the aerosol precursor composition can be located near an end of the article (e.g., within a cartridge, which in certain circumstances can be replaceable and disposable), which may be proximal to the mouth of a user so as to maximize aerosol delivery to the user. Other configurations, however, are not excluded. Generally, the heating element can be positioned sufficiently near the aerosol precursor composition so that heat from the heating element can volatilize the aerosol precursor (as well as one or more flavorants, medicaments, or the like that may likewise be provided for delivery to a user) and form an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various aerosol delivery device components can be appreciated upon consideration of the commercially available electronic aerosol delivery devices, such as those representative products listed in the background art section of the present disclosure.

An aerosol delivery device incorporates a battery or other electrical power source to provide current flow sufficient to provide various functionalities to the article, such as resistive heating, powering of control systems, powering of indicators, and the like. The power source can take on various embodiments. Preferably, the power source is able to deliver sufficient power to rapidly heat the heating member to provide for aerosol formation and power the article through use for the desired duration of time. The power source preferably is sized to fit conveniently within the aerosol delivery device so that the aerosol delivery device can be easily handled; and additionally, a preferred power source is of a sufficiently light weight to not detract from a desirable smoking experience.

One example embodiment of an aerosol delivery device 100 that may be used with various embodiments is provided in FIG. 1. As seen in the cross-section illustrated therein, the aerosol delivery device 100 can comprise a control body 102 and a cartridge 104 that can be permanently or detachably aligned in a functioning relationship. In this regard, the control body 102 may include a cartridge engaging portion and the cartridge 104 may include a control body engaging portion to support engagement of the control body 102 and cartridge 104 such that the control body 102 and cartridge 104 may be aligned in a functioning relationship. For example, a cartridge engaging portion of the control body 102 may be provided by one or more aspects the coupler 120, the proximal attachment end 122, and/or control body projection 124, as described further below. The control body engaging portion of the cartridge 104 may, for example, be provided by one or more aspects of the plug 140 and/or a distal attachment end 142, as described further below. Although a threaded engagement of the control body 102 and cartridge 104 is illustrated in FIG. 1, it is understood that further means of engagement may be employed, such as a press-fit engagement, interference fit, a magnetic engagement, or the like.

In specific embodiments, one or both of the control body 102 and the cartridge 104 may be referred to as being disposable or as being reusable. For example, the control body may have a replaceable battery or a rechargeable battery and thus may be combined with any type of recharging technology, including connection to a typical electrical outlet, connection to a car charger (e.g., cigarette lighter receptacle), and connection to a computer, such as through a universal serial bus (USB) cable. For example, an adaptor including a USB connector at one end and a control body connector at an opposing end is disclosed in U.S. patent application Ser. No. 13/840,264, filed Mar. 15, 2013, which is incorporated herein by reference in its entirety. It will be appreciated that embodiments including a rechargeable battery may include any type of rechargeable battery, such as by way of non-limiting example, a lithium ion battery (e.g., a rechargeable lithium-manganese dioxide battery), lithium ion polymer battery, nickel-zinc battery, nickel-metal hydride battery, nickel cadmium battery, rechargeable alkaline battery, some combination thereof, and/or other type of rechargeable battery. Further, in some embodiments the cartridge may comprise a single-use cartridge, as disclosed in U.S. Pat. App. Pub. No. 2014/0060555 to Chang et al., which is incorporated herein by reference in its entirety.

In the exemplified embodiment, the control body 102 includes a control component 106 (e.g., a microcontroller), a flow sensor 108, and a battery 110, which can be variably aligned, and can include a plurality of indicators 112 at a distal end 114 of an outer body 116. The indicators 112 can be provided in varying numbers and can take on different shapes and can even be an opening in the body (such as for release of sound when such indicators are present). In the exemplified embodiment, a haptic feedback component 101 is included with the control component 106. As such, the haptic feedback component may be integrated with one or more components of a smoking article for providing vibration or like tactile indication of use or status to a user. See, for example, the disclosure of U.S. patent application Ser. No. 13/946,309, filed Jul. 19, 2013, which is incorporated herein by reference in its entirety.

An air intake 118 may be positioned in the outer body 116 of the control body 102. A coupler 120 also is included at the proximal attachment end 122 of the control body 102 and may extend into a control body projection 124 to allow for ease of electrical connection with an atomizer or a component thereof, such as a resistive heating element (described below) when the cartridge 104 is attached to the control body. Although the air intake 118 is illustrated as being provided in the outer body 116, in another embodiment the air intake may be provided in a coupler as described, for example, in U.S. patent application Ser. No. 13/841,233; Filed Mar. 15, 2013.

The cartridge 104 includes an outer body 126 with a mouth opening 128 at a mouthend 130 thereof to allow passage of air and entrained vapor (i.e., the components of the aerosol precursor composition in an inhalable form) from the cartridge to a consumer during draw on the aerosol delivery device 100. The aerosol delivery device 100 may be substantially rod-like or substantially tubular shaped or substantially cylindrically shaped in some embodiments. In other embodiments, further shapes and dimensions are encompassed—e.g., a rectangular or triangular cross-section, or the like.

The cartridge 104 further includes an atomizer 132 comprising a resistive heating element 134 (e.g., a wire coil) configured to produce heat and a liquid transport element 136 (e.g., a wick) configured to transport a liquid. Various embodiments of materials configured to produce heat when electrical current is applied therethrough may be employed to form the resistive heating element 134. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), and ceramic (e.g., a positive temperature coefficient ceramic). Further to the above, representative heating elements and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

Electrically conductive heater terminals 138 (e.g., positive and negative terminals) at the opposing ends of the heating element 134 are configured to direct current flow through the heating element and configured for attachment to the appropriate wiring or circuit (not illustrated) to form an electrical connection of the heating element with the battery 110 when the cartridge 104 is connected to the control body 102. Specifically, a plug 140 may be positioned at a distal attachment end 142 of the cartridge 104. When the cartridge 104 is connected to the control body 102, the plug 140 engages the coupler 120 to form an electrical connection such that current controllably flows from the battery 110, through the coupler and plug, and to the heating element 134. The outer body 126 of the cartridge 104 can continue across the distal attachment end 142 such that this end of the cartridge is substantially closed with the plug 140 protruding therefrom.

A liquid transport element can be combined with a reservoir to transport an aerosol precursor composition to an aerosolization zone. In the embodiment shown in FIG. 1, the cartridge 104 includes a reservoir layer 144 comprising layers of nonwoven fibers formed into the shape of a tube encircling the interior of the outer body 126 of the cartridge, in this embodiment. An aerosol precursor composition is retained in the reservoir layer 144. Liquid components, for example, can be sorptively retained by the reservoir layer 144. The reservoir layer 144 is in fluid connection with a liquid transport element 136. The liquid transport element 136 transports the aerosol precursor composition stored in the reservoir layer 144 via capillary action to an aerosolization zone 146 of the cartridge 104. As illustrated, the liquid transport element 136 is in direct contact with the heating element 134 that is in the form of a metal wire coil in this embodiment.

It is understood that an aerosol delivery device that can be manufactured according to the present disclosure can encompass a variety of combinations of components useful in forming an electronic aerosol delivery device. Reference is made for example to the reservoir and heater system for controllable delivery of multiple aerosolizable materials in an electronic smoking article disclosed in U.S. Pat. App. Pub. No. 2014/0000638 to Sebastian et al., which is incorporated herein by reference in its entirety. Further, U.S. Pat. App. Pub. No. 2014/0060554 to Collett et al., discloses an electronic smoking article including a microheater, and which is incorporated herein by reference in its entirety.

Reference also is made to U.S. Pat. Pub. No. 2013/0213419, which discloses a ribbon of electrically resistive mesh material that may be wound around a wick, and to U.S. Pat. Pub. No. 2013/0192619, which discloses a heater coil about a wick wherein the coil windings have substantially uniform spacing between each winding. In certain embodiments according to the present disclosure, a heater may comprise a metal wire, which may be wound with a varying pitch around a liquid transport element, such as a wick. An exemplary variable pitch heater than may be used according to the present disclosure is described in U.S. patent application Ser. No. 13/827,994, filed Mar. 14, 2013, the disclosure of which is incorporated herein by reference in its entirety.

Reference also is made to a liquid supply reservoir formed of an elastomeric material and adapted to be manually compressed so as to pump liquid material therefrom, as disclosed in U.S. Pat. Pub. No. 2013/0213418. In certain embodiments according to the present disclosure, a reservoir may particularly be formed of a fibrous material, such as a fibrous mat or tube that may absorb or adsorb a liquid material.

In another embodiment substantially the entirety of the cartridge may be formed from one or more carbon materials, which may provide advantages in terms of biodegradability and absence of wires. In this regard, the heating element may comprise a carbon foam, the reservoir may comprise carbonized fabric, and graphite may be employed to form an electrical connection with the battery and controller. Such carbon cartridge may be combined with one or more elements as described herein for providing illumination of the cartridge in some embodiments. An example embodiment of a carbon-based cartridge is provided in U.S. Pat. App. Pub. No. 2013/0255702 to Griffith, Jr. et al., which is incorporated herein by reference in its entirety.

In use, when a user draws on the article 100, the heating element 134 is activated (e.g., such as via a flow sensor), and the components for the aerosol precursor composition are vaporized in the aerosolization zone 146. Drawing upon the mouthend 130 of the article 100 causes ambient air to enter the air intake 118 and pass through the central opening in the coupler 120 and the central opening in the plug 140. In the cartridge 104, the drawn air passes through an air passage 148 in an air passage tube 150 and combines with the formed vapor in the aerosolization zone 146 to form an aerosol. The aerosol is whisked away from the aerosolization zone 146, passes through an air passage 152 in an air passage tube 154, and out the mouth opening 128 in the mouthend 130 of the article 100.

The various components of an aerosol delivery device according to the present disclosure can be chosen from components described in the art and commercially available.

Examples of batteries that can be used according to the disclosure are described in U.S. Pat. App. Pub. No. 2010/0028766, the disclosure of which is incorporated herein by reference in its entirety.

An exemplary mechanism that can provide puff-actuation capability includes a Model 163PC01D36 silicon sensor, manufactured by the MicroSwitch division of Honeywell, Inc., Freeport, Ill. Further examples of demand-operated electrical switches that may be employed in a heating circuit according to the present disclosure are described in U.S. Pat. No. 4,735,217 to Gerth et al., which is incorporated herein by reference in its entirety. Further description of current regulating circuits and other control components, including microcontrollers that can be useful in the present aerosol delivery device, are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

Reference also is made to International Publications WO 2013/098396, WO 2013/098397, and WO 2013/098398, which describe controllers configured to control power supplied to a heater element from a power source as a means to monitor a status of the device, such as heater temperature, air flow past a heater, and presence of an aerosol forming material near a heater. In particular embodiments, the present disclosure provides a variety of control systems adapted to monitor status indicators, such as through communication of a microcontroller in a control body and a microcontroller or other electronic component in a cartridge component.

The aerosol precursor, which may also be referred to as an aerosol precursor composition or a vapor precursor composition, can comprise one or more different components. For example, the aerosol precursor can include a polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference.

Still further components can be utilized in the aerosol delivery device of the present disclosure. For example, U.S. Pat. No. 5,154,192 to Sprinkel et al. discloses indicators that may be used with smoking articles; U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. App. Pub. No. 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,388,574 to Ingebrethsen; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. No. 8,156,944 to Hon; U.S. Pat. No. 8,365,742 to Hon; U.S. Pat. No. 8,375,957 to Hon; U.S. Pat. No. 8,393,331 to Hon; U.S. Pat. App. Pub. Nos. 2006/0196518 and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; WO 2010/091593 to Hon; WO 2013/089551 to Foo; U.S. patent application Ser. No. 13/841,233, filed Mar. 15, 2013; and U.S. patent application Ser. No. 14/170,838, filed Feb. 3, 2014, each of which is incorporated herein by reference in its entirety. A variety of the materials disclosed by the foregoing documents may be incorporated into the present devices in various embodiments, and all of the foregoing disclosures are incorporated herein by reference in their entireties.

The foregoing description of use of the article can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure.

A further exemplary embodiment of a smoking article 200 (e.g., an aerosol delivery device) including a reservoir housing 244 that may be used with various embodiments according to the present disclosure is shown in FIG. 2. As illustrated therein, a control body 202 can be formed of a control body shell 201 that can include a control component 206, a flow sensor 208, a battery 210, and an LED 212. A cartridge 204 can be formed of a cartridge shell 203 enclosing the reservoir housing 244 that is in fluid communication with a liquid transport element 236 adapted to wick or otherwise transport an aerosol precursor composition stored in the reservoir housing to a heater 234. An opening 228 may be present in the cartridge shell 203 to allow for egress of formed aerosol from the cartridge 204. Such components are representative of the components that may be present in a cartridge and are not intended to limit the scope of cartridge components that are encompassed by the present disclosure. The cartridge 204 may be adapted to engage the control body 202 through a press-fit engagement between the control body projection 224 and the cartridge receptacle 240. Such engagement can facilitate a stable connection between the control body 202 and the cartridge 204 as well as establish an electrical connection between the battery 210 and control component 206 in the control body and the heater 234 in the cartridge. In this regard, the control body projection 224 may provide a cartridge engaging portion, while the cartridge receptacle 240 may provide a control body engaging portion to enable a functional engagement between the control body 202 and cartridge 204. The cartridge 204 also may include one or more electronic components 250, which may include an IC, a memory component, a sensor, or the like. The electronic component 250 may be adapted to communicate with the control component 206.

In some embodiments, an electronic smoking article can comprise a hollow shell that is adapted to enclose one or more further elements of the device. The hollow shell may be a single unitary piece that includes all elements of the electronic smoking article. In two piece embodiments, such as described above, the hollow shell may relate to a cartridge shell or a control body shell.

Having described several example embodiments of aerosol delivery devices that may be used with various example embodiments, several embodiments of an aerosol delivery device and related methods and computer program products for controlling an aerosol delivery device based at least in part on input characteristics will now be described. Some such example embodiments disclosed herein benefit aerosol device users by enabling users to provide a wider variety of control inputs for performance of various control functions to an aerosol delivery device. In this regard, the aerosol delivery device of some example embodiments may be configured to determine a control function to be performed in response to a user input based at least in part on a characteristic of the user input. Thus, for example, an input mechanism of a user interface of an aerosol delivery device may be used to provide multiple distinct control inputs and/or may be repurposed to cause performance of a control function other than a default function associated with the user interface mechanism depending on a characteristic of a user input to the input mechanism. For example, in some embodiments, a puff input to an aerosol delivery device may be leveraged to perform one or more control functions beyond triggering the heating of aerosol precursor composition to form an inhalable substance depending on a characteristic of the puff input.

Some example embodiments may accordingly be used to increase the number of control inputs that may be provided to an aerosol delivery device, thus providing users with a finer level of control over device functionality without adding additional input mechanisms to an aerosol delivery device. This diversification of control inputs that may be provided by a given input mechanism may thus provide a user with additional control over an aerosol delivery device without necessitating the addition of further input mechanisms to the aerosol delivery device, which may be cost prohibitive and/or result in an undesirable device form factor.

FIG. 3 illustrates a block diagram of an apparatus 300 that may be implemented on an aerosol delivery device, such as aerosol delivery device 100 and/or smoking article 200 in accordance with some example embodiments. In some example embodiments, apparatus 300 may be implemented on a control body, such as control body 102 and/or control body 202, of an aerosol delivery device. It will be appreciated that the components, devices or elements illustrated in and described with respect to FIG. 3 below may not be mandatory and thus some may be omitted in certain embodiments. Additionally, some embodiments may include further or different components, devices or elements beyond those illustrated in and described with respect to FIG. 3.

In some example embodiments, the apparatus 300 may include processing circuitry 310 that is configurable to perform and/or control performance of functions of an aerosol delivery device in accordance with one or more example embodiments disclosed herein. Thus, the processing circuitry 310 may be configured to perform data processing, application execution and/or other processing and management services that may be implemented to perform functionality of the aerosol delivery device according to one or more example embodiments.

In some embodiments, the apparatus 300 or a portion(s) or component(s) thereof, such as the processing circuitry 310, may include one or more chipsets, which may each include one or more chips. The processing circuitry 310 and/or one or more further components of the apparatus 300 may therefore, in some instances, be configured to implement an embodiment on a chipset, which may be implemented on an aerosol delivery device.

The processing circuitry 310 may, for example, comprise an embodiment of control component 106, control component 206, and/or electronic components 250. In some example embodiments, the processing circuitry 310 may include a processor 312 and, in some embodiments, such as that illustrated in FIG. 3, may further include a memory 314. The processing circuitry 310 may be in communication with and/or control a user interface 316, one or more sensors 318, and/or control module 320.

The processor 312 may be embodied in a variety of forms. For example, the processor 312 may be embodied as various hardware-based processing means such as a microprocessor, a coprocessor, a controller or various other computing or processing devices including integrated circuits such as, for example, an ASIC (application specific integrated circuit), an FPGA (field programmable gate array), some combination thereof, or the like. Although illustrated as a single processor, it will be appreciated that the processor 312 may comprise a plurality of processors. The plurality of processors may be in operative communication with each other and may be collectively configured to perform one or more functionalities of an aerosol delivery device on which the apparatus 300 may be implemented. In some example embodiments, the processor 312 may be configured to execute instructions that may be stored in the memory 314 and/or that may be otherwise accessible to the processor 312. As such, whether configured by hardware or by a combination of hardware and software, the processor 312 may be capable of performing operations according to various embodiments while configured accordingly.

In some example embodiments, the memory 314 may include one or more memory devices. Memory 314 may include fixed and/or removable memory devices. In some embodiments, the memory 314 may provide a non-transitory computer-readable storage medium that may store computer program instructions that may be executed by the processor 312. In this regard, the memory 314 may be configured to store information, data, applications, instructions and/or the like for enabling the apparatus 300 to carry out various functions of a control body in accordance with one or more example embodiments. For example, in some embodiments, memory 314 may be configured to store control software, configuration settings, and/or other data, programs, and/or the like that may be used to control operation of an aerosol delivery device. In some embodiments, the memory 314 may be in communication with one or more of the processor 312, user interface 316, sensor(s) 318, or control module 320 via a bus (or buses) for passing information among components of the apparatus 300.

In some example embodiments, the apparatus 300 may further include the user interface 316. The user interface 316 may be in communication with the processing circuitry 310 to receive an indication of a user input and/or to provide an audible, visual, mechanical, or other output to a user. For example, the user interface 316 may include one or more buttons, keys, and/or other input mechanisms to enable a user to control operation of an aerosol delivery device. For example, the user interface 316 may provide an input mechanism(s) to enable a user to power an aerosol delivery device on/off, to activate a heating element to generate a vapor or aerosol for inhalation, and/or to otherwise actuate and/or control functionality of an aerosol delivery device. In some example embodiments, the user interface 316 may include an input mechanism, such as a mouth opening 128, mouthend 130, and/or associated puff sensing components, which may enable a user to provide a puff input to an aerosol delivery device. As a further example, the user interface 316 may provide one or more indicators (e.g., indicators 112), such one or more LEDs (e.g., LED 212), a display, a speaker, and/or other output mechanism that may be used to indicate an operating status of an aerosol delivery device, a charge level of a battery, an amount of aerosol precursor composition remaining in a cartridge that may be engaged with the control body, and/or to provide other status information that may be related to operation of an aerosol delivery device to a user. In some example embodiments, the user interface 316 may include a vibrator and/or other haptic feedback device (e.g., haptic feedback component 101), which may impart a vibration and/or other motion on the aerosol delivery device, such as to provide feedback in response to a user input, provide a status notification (e.g., a status related to a remaining battery charge level, a status related to a level of aerosol precursor composition in a cartridge, and/or other status notification that may be provided), and/or to provide other feedback or notification to a user.

The apparatus 300 may further include one or more sensors 318. A sensor 318 may be implemented as part of the user interface 316 and/or may assist the user interface 316 to facilitate detection of a user input and/or one or more characteristics thereof. In some embodiments, the sensor(s) 318 may include a puff sensor, which may be configured to detect a puff input to an aerosol delivery device. In embodiments in which the apparatus 300 includes a puff sensor, the puff sensor may be embodied via any of the variety of puff sensors discussed above and/or other suitable sensor for detecting a user puff on an aerosol delivery device. For example, the senor 318 may include a puff sensor that may be configured to detect a pressure change and/or air flow change that may result when a user puffs (e.g., draws) on an aerosol delivery device, such as via mouthend 130 of the aerosol delivery device 100. As a further example, the sensor 318 may include a puff sensor that may include one or more piezoelectric sensors that may be associated with a mouthend of an aerosol delivery device to detect user lip activity associated with a puff input. In some example embodiments, the sensor 318 may be configured to detect a reverse puff, which may be characterized by an air flow change and/or pressure change that is a reverse of that associated with a puff drawing in air to inhale vaporized aerosol precursor composition. A reverse puff may, for example, be triggered by a user blowing into a mouthend of an aerosol delivery device rather than drawing. As another example, a reverse puff may be triggered by a user drawing on an air intake, such as air intake 118, to cause airflow to flow reverse of a direction associated with airflow when a user draws on a mouthend. In some example embodiments, the sensor(s) 318 may additionally or alternatively include one or more motion sensor, which may be configured to motion and/or changes in orientation of an aerosol delivery device that may result from manipulation of the aerosol delivery device. By way of non-limiting example, embodiments including a motion sensor may include an accelerometer, gyroscope, inclinometer, and/or other sensor that may be configured to detect motion of an aerosol delivery device responsive to manipulation thereof and/or characteristics of the motion. For example, a motion sensor in accordance with some example embodiments may be configured to measure and/or otherwise sense an acceleration (and/or change therein), an angular displacement, rotation, orientation, and/or other characteristics of motion that may be associated with a manipulation of an aerosol delivery device.

The apparatus 300 may further include control module 320. The control module 320 may be embodied as various means, such as circuitry, hardware, a computer program product comprising a computer readable medium (for example, the memory 314) storing computer readable program instructions that are executable by a processing device (for example, the processor 312), or some combination thereof. In some embodiments, the processor 312 (or the processing circuitry 310) may include, or otherwise control the control module 320.

The control module 320 may be configured to determine one or more characteristics associated with a user input that may be received via user interface 316. In some example embodiments, the control module 320 may be configured to determine one or more characteristics of a user input based at least in part on information that may be detected and provided by sensor(s) 318.

For example, in some embodiments, a user input may comprise a puff input, which may be comprised of one or more puffs. The control module 320 may be configured to determine a duration of a puff, a total number of puffs in the puff input, an interval between two respective puffs in the puff input, a force of a puff (e.g., as may be measured by an amount of air drawn by the puff, a velocity of air drawn by the puff, and/or the like), and/or other characteristic of a puff input. In some example embodiments, the puff input may comprise a reverse puff input, and the control module 320 may be configured to distinguish the puff input as a reverse puff input from a normal puff input and/or may determine one or more characteristics of the reverse puff input, such as a duration of the reverse puff, a total number of reverse puffs, an interval between reverse puff inputs, a force of the reverse puff, and/or the like. As such, where determination of characteristics of a puff, such as a duration of a puff, a total number of puffs in the puff input, an interval between two respective puffs in the puff input, a force of a puff, and/or the like, are described, it will be appreciated that such puff characteristics can include detection of characteristics of a reverse puff. As a further example, in some embodiments, a user input may comprise manipulation of an aerosol delivery device. The control module 320 may be configured to determine (e.g., based at least in part on data that may be detected and provided by a motion sensor) one or more characteristics of the manipulation, such as an acceleration (and/or change therein), an angular displacement, direction of motion, orientation, a number of repetitively occurring motion patterns that may be performed in a manipulation (e.g., shaking the device back and forth, tapping the device multiple times, etc.), and/or other characteristics of motion that may be associated with a manipulation of an aerosol delivery device. The control module 320 may be further configured to determine a type of the manipulation. For example, a manipulation type may include rotation of the aerosol delivery; shaking the aerosol delivery device; tilting the aerosol delivery device; performing a simulated ashing manipulation, such as by tapping and/or flicking the aerosol delivery device (e.g., as if ashing a regular cigarette); and/or other manipulation of the aerosol delivery device. In this regard, a manipulation type may be considered a characteristic of a manipulation that may be determined based at least in part on one or more further characteristics of the manipulation that may be detected based at least in part on data from a motion sensor. For example, a shaking manipulation may be characterized by a repeated series of accelerations and decelerations in substantially opposing directions on a plane. In some example embodiments, a manipulation input may comprise a series of movements that may include multiple types of manipulations.

As an additional example, in some embodiments, a user input may comprise a series and/or combination of inputs that may utilize multiple input mechanisms that may be provided by the user interface 316. For example, in some embodiments, a user input may comprise a puff input and/or manipulation input in combination with user actuation of a button that may be provided by the user interface 316. As a further example, in some embodiments, a user input may comprise a sequence comprised of some sequential combination of one or more actuations of a button(s), one or more puff inputs, one or more manipulation inputs, and/or one or inputs via some other user input mechanism(s) that may be provided by the user interface 316.

Respective user input characteristics may have defined associations with respective control functions. The control module 320 may accordingly configured to determine a control function having a defined association with a characteristic(s) of a received user input to an aerosol delivery device. For example, some embodiments may utilize a database and/or other data structure, which may store a library of control functions and respective associated user input characteristics. In this regard, given a determined characteristic of a user input, the control module 320 of some example embodiments may be configured to look up the characteristic in the data structure and determine a control function having a defined association with the characteristic.

The control module 320 may be further configured to perform a control function associated with a characteristic(s) of a received user input. It will be appreciated that any control function that may be performed by an aerosol delivery device may be associated with a given characteristic of a user input.

For example, in some embodiments, the control module 320 may be configured to provide a status indication in response to a user input having a particular characteristic(s). The status indication may comprise any status indication that may be related to operation of an aerosol delivery device and/or a consumable component thereof. For example, in some embodiments, an indication of a level of aerosol precursor composition remaining in a cartridge engaged with the aerosol delivery device may be provided in response to a user input having a particular characteristic(s). As a further example, in some embodiments, an indication of a charge level of a battery that may be implemented on the aerosol delivery device may be provided in response to a user input having a particular characteristic(s). Such status indications may, for example, be provided via any output mechanism that may be included on the user interface 316. For example, one or more LEDs and/or other indicator(s) may be configured to display various colors, various brightness levels, a varying number of illuminated indicators, some combination thereof, or the like to indicate a status, such as a level of aerosol precursor composition and/or a remaining battery charge level. As a further example, such status information may be displayed on a display that may be included on an aerosol delivery device in accordance with some embodiments.

In some example embodiments, the control module 320 may be configured to modify a configuration setting(s) of the aerosol delivery device in response to a user input having a particular characteristic(s). The modified configuration setting(s) may include a setting for any adjustable operating parameter that may relate to operation of an aerosol delivery device.

For example, the modifying a configuration setting may comprise modifying a configuration setting for an element of the user interface 316, such as the functionality of an LED and/or other indicator(s) that may be provided by the user interface 316, a vibrator and/or other haptic feedback device, and/or other user interface element. In embodiments in which the user interface 316 includes a vibrator and/or other haptic feedback device, it will be appreciated that any of a variety of haptic feedback configuration settings may be modified. For example, a vibration strength of a haptic feedback device may be increased or decreased based on characteristics of a user input in accordance with some example embodiments. Additionally or alternatively, as another example, haptic feedback (e.g., for various event notifications) can be activated/deactivated based on characteristics of a user input in accordance with some example embodiments.

As a further example, a heating profile configuration setting may be modified. As another example, modification of a configuration setting may comprise modifying an aerosol precursor composition vaporization setting, such as a configuration defining an amount of aerosol precursor composition that is vaporized per puff, and/or other configuration setting that may relate to the vaporization of aerosol precursor composition. As still a further example, modification of a configuration setting may comprise modifying a puff control setting, such as a number of puffs that are allowed within a period of time and/or for a single smoking session, a minimum interval of time that must elapse between puffs, and/or other setting that may govern device behavior with respect to user puffs. In some embodiments, a battery management setting, such as a configuration relating to charging of a battery and/or a configuration that may regulate consumption of the battery, may be modified.

As an additional example, the control module 320 may be configured to activate/deactivate a wireless communication interface that may be implemented on an aerosol delivery device in response to a user input having a particular characteristic(s). For example, an aerosol delivery device in accordance with some example embodiments may implement one or more wireless communication interfaces that may enable the aerosol delivery device to communicate data to and/or receive data from another device. For example, the aerosol delivery device of some embodiments may include a Bluetooth interface, Near Field Communication (NFC) interface, an infrared (IR) interface, a Wi-Fi interface, and/or other wireless communication interface. In such embodiments, a wireless communication interface(s) may be activated/deactivated in response to a user input having a particular characteristic(s).

In some example embodiments, the control function that may be performed in response to a user input (e.g., based on a characteristic of the user input) may be a function other than a default function that may be associated with an input mechanism via which the user input was received. For example, if the user input was a puff input, the control function may be a function other than heating aerosol precursor composition to form an inhalable substance. As another example, if the user input included actuation of a button used for toggling a power state (e.g., on/off) of the aerosol delivery device, the control function may comprise a control function other than toggling the power state. In some such example embodiments, a characteristic of the user input may be used by the control module 320 to determine that a control function other than a default function associated with the input mechanism should be performed. As a non-limiting example, if a puff input is comprised of a sequence of one or more short draws (e.g., puffs having less than a defined duration) is received, the control module 320 may determine that a control function other than and/or in addition to heating aerosol precursor composition to form an inhalable substance should be performed, and may determine and perform the associated control function.

FIG. 4 illustrates a flowchart according to an example method for controlling an aerosol delivery device based at least in part on input characteristics in accordance with some example embodiments of the present disclosure. One or more of processing circuitry 310, processor 312, memory 314, user interface 316, sensor(s) 318, or control module 320 may, for example, provide means for performing one or more of the operations illustrated in and described with respect to FIG. 4.

Operation 400 may comprise an aerosol delivery device determining a characteristic(s) of a user input to the aerosol delivery device. The user input may comprise any single input and/or combination of inputs via one or more user interface mechanisms. By way of non-limiting example, the user input may comprise a puff input, manipulation input, and/or other form of input.

Operation 410 may comprise the aerosol delivery device determining a control function having a defined association with the characteristic(s) determined in operation 400. Operation 420 may comprise the aerosol delivery device performing the determined control function in response to the user input.

FIG. 5 illustrates a flowchart according to an example method for controlling an aerosol delivery device based at least in part on characteristics of a puff input in accordance with some example embodiments of the present disclosure. In this regard, FIG. 5 illustrates an embodiment of the method of FIG. 4 in which the user input may comprise a puff input. One or more of processing circuitry 310, processor 312, memory 314, user interface 316, sensor(s) 318, or control module 320 may, for example, provide means for performing one or more of the operations illustrated in and described with respect to FIG. 5.

Operation 500 may include an aerosol delivery device sensing a puff input, such as may comprise one or more puffs and/or one or more reverse puffs, to the aerosol delivery device. For example, a puff sensor that may be provided by sensor(s) 318 may be used to detect the puff input.

Operation 510 may comprise determining one or more characteristics of the puff input. For example, operation 510 may include determining a duration of a puff, a total number of puffs in the puff input, an interval between two respective puffs in the puff input, a force of a puff (e.g., as may be measured by an amount of air drawn by the puff, a velocity of air drawn by the puff, and/or the like), and/or other characteristic of the puff input. In this regard, operation 510 may, for example, correspond to an embodiment of operation 400 in which the user input comprises a puff input.

Operation 520 may comprise the aerosol delivery device determining a control function having a defined association with the characteristic(s) determined in operation 510. Operation 520 may accordingly correspond to an embodiment of operation 410. Operation 530 may comprise the aerosol delivery device performing the determined control function in response to the puff input. Operation 530 may accordingly correspond to an embodiment of operation 420.

Any of a variety of control functions may be performed based on a characteristic of a puff input. In this regard, different puff durations, puff counts (e.g., number of puffs in a puff input), intervals between puffs, puff forces, and/or other puff input characteristics may be associated with different respective control functions such that a puff input may be used to achieve a user desired functionality other than or in addition to heating aerosol precursor composition to form an inhalable substance.

For example, in some embodiments, a puff input comprising three short puffs in sequence (e.g., three sequential puffs having less than a threshold duration) may result in the provision of an indication of the level of aerosol precursor composition remaining in a cartridge. As another example, a puff input comprising two long puffs (e.g., two sequential puffs having greater than a threshold duration) may be used to check the charge level remaining in a battery of the aerosol delivery device.

As a further example, in some embodiments, characteristics such as a puff duration and/or a force of a puff may be used to modify a configuration setting having a range of possible setting values. For example, a puff having a duration and/or force exceeding a threshold may be used to increase an amount of aerosol precursor composition vaporized per puff, while a puff having a duration and/or force that does not exceed the threshold may be used to decrease the amount of aerosol precursor composition vaporized per puff.

As another example, a reverse puff may be used to modify a setting value of a configuration setting in one direction, while a normal puff in a manner that may be used for inhaling vaporized aerosol precursor composition may be used to modify a setting value of the configuration setting in another direction. As a particular example application of modifying a configuration setting based on discrimination between a normal puff and a reverse puff, a normal puff may be used to increase an amount of aerosol precursor composition vaporized per puff, while a reverse puff may be used to decrease the amount of aerosol precursor composition vaporized per puff.

FIG. 6 illustrates a flowchart according to an example method for controlling an aerosol delivery device based at least in part on characteristics of a manipulation of the aerosol delivery device in accordance with some example embodiments of the present disclosure. In this regard, FIG. 6 illustrates an embodiment of the method of FIG. 4 in which the user input may comprise manipulation of the aerosol delivery device. One or more of processing circuitry 310, processor 312, memory 314, user interface 316, sensor(s) 318, or control module 320 may, for example, provide means for performing one or more of the operations illustrated in and described with respect to FIG. 6.

Operation 600 may include an aerosol delivery device sensing a manipulation of the aerosol delivery device. For example, a motion sensor that may be provided by sensor(s) 318 may be used to detect the manipulation.

Operation 610 may comprise determining one or more characteristics of the manipulation. For example, operation 610 may include determining a type of manipulation, a direction of motion of the aerosol delivery device, a change in orientation of the aerosol delivery device resulting from the manipulation, an angular displacement of the aerosol delivery device resulting from the manipulation, an acceleration (and/or change therein) associated with the manipulation, a number of repetitively occurring motion patterns in the manipulation, and/or other characteristics of motion that may be associated with a manipulation of an aerosol delivery device. In this regard, operation 610 may, for example, correspond to an embodiment of operation 400 in which the user input comprises manipulation of the aerosol delivery device.

Operation 620 may comprise the aerosol delivery device determining a control function having a defined association with the characteristic(s) determined in operation 610. Operation 620 may accordingly correspond to an embodiment of operation 410. Operation 630 may comprise the aerosol delivery device performing the determined control function in response to the manipulation. Operation 630 may accordingly correspond to an embodiment of operation 420.

Any of a variety of control functions may be performed based on a characteristic of a manipulation. For example, in some embodiments, shaking the aerosol delivery device may result in the provision of an indication of the charge level remaining in a battery of the aerosol delivery device. As another example, in some embodiments, manipulating the aerosol delivery device as if ashing a real cigarette, such as by flicking or tapping the aerosol delivery device a defined number of times (e.g., three), may be used to check the level of aerosol precursor composition remaining in a cartridge.

As a further example, in some embodiments, characteristics such as a direction of motion and/or angular displacement of a manipulation may be used to modify a configuration setting having a range of possible setting values. For example, manipulation by rotating and/or tilting the aerosol delivery device in a first direction may be used to increase an amount of aerosol precursor composition vaporized per puff, while rotating and/or tilting the aerosol delivery device in a second direction may be used to decrease the amount of aerosol precursor composition vaporized per puff. As another example, manipulation involving an angular displacement exceeding a threshold may be used to increase the amount of precursor composition vaporized per puff, while manipulation involving an angular displacement that does not exceed the threshold may be used to decrease the amount of aerosol precursor composition vaporized per puff.

The aerosol delivery device of some example embodiments may be toggled between different control modes. For example, an aerosol delivery device may be operated in a first control mode in which a user input via an input mechanism may result in performance of a default function associated with the input mechanism, or may be operated in a second control mode in which an alternate control function may be performed based at least in part on a characteristic of the user input, such as in accordance with one or more of the methods of FIGS. 4-6. As a more particular example of some such embodiments, a puff input may be used to trigger heating of aerosol precursor composition to form an inhalable substance when operating in a first control mode, while an alternate control function other than heating aerosol precursor composition may be performed in response to a puff input when operating in a second control mode. For example, a user input, such as actuation of a button may be performed prior to and/or contemporaneously with a user input, such as a puff input or manipulation, to trigger activation of an alternate control mode that may be used to perform a control function based at least in part on a characteristic of the user input in accordance with one or more of the methods of FIGS. 4-6.

FIG. 7 illustrates a flowchart according to an example method for changing a control mode for an aerosol delivery device in accordance with some such example embodiments. One or more of processing circuitry 310, processor 312, memory 314, user interface 316, sensor(s) 318, or control module 320 may, for example, provide means for performing one or more of the operations illustrated in and described with respect to FIG. 7.

Operation 700 may comprise an aerosol delivery device receiving a user input to change a control mode to an alternate control mode. Operation 710 may comprise changing the control mode to the alternate control mode in response to the user input.

It will be appreciated that the method of FIG. 7 may be applied in combination with any one or more of the methods of FIGS. 4-6. For example, if applied in combination with the method of FIG. 5, the puff input that may be sensed in operation 500 may result in heating of aerosol precursor composition to form an inhalable substance and operations 510-530 may be omitted if the aerosol delivery device is not operating in the alternate control mode. However, if operating in the alternate control mode as a result of operations 700-710, operations 510-530 may be performed in response to the puff input.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a puff sensor configured to detect a puff input to the aerosol delivery device; and processing circuitry coupled with the puff sensor, wherein the processing circuitry is configured to cause the aerosol delivery device to at least:

determine a characteristic of the puff input that is a single puff on the aerosol delivery device, the characteristic of the puff input including a duration or force of the single puff;

determine the characteristic of the puff input has a defined association with a control function;

cause the aerosol delivery device to both form an inhalable substance from an aerosol precursor composition, and perform the control function when the characteristic of the puff input does have the defined association with the control function, in response to the puff input, the processing circuitry configured to cause the aerosol delivery device to form the inhalable substance without the control function being performed when the characteristic of the puff input does not have the defined association with the control function; and cause the aerosol delivery device to provide an indication of a level of aerosol precursor composition remaining in a cartridge operatively engaged with the aerosol delivery device in response to the puff input.

2. The aerosol delivery device of claim 1, wherein the aerosol delivery device further comprises a battery, and wherein processing circuitry configured to cause the aerosol delivery device to perform the control function includes the processing circuitry configured to cause the aerosol delivery device to provide an indication of a charge level of the battery in response to the puff input.

3. The aerosol delivery device of claim 1, wherein the processing circuitry configured to cause the aerosol delivery device to perform the control function includes the processing circuitry configured to cause the aerosol delivery device to modify a configuration setting of the aerosol delivery device.

4. The aerosol delivery device of claim 3, wherein the processing circuitry configured to cause the aerosol delivery device to modify the configuration setting includes the processing circuitry configured to cause the aerosol delivery device to modify one or more of a configuration setting for a light emitting diode (LED) indicator, a haptic feedback configuration, a heating profile configuration, an aerosol precursor composition vaporization setting, a puff control setting, or a battery management setting.

5. The aerosol delivery device of claim 1, wherein the processing circuitry is configured to cause the aerosol delivery device to determine whether the characteristic of the puff input has the defined association with the control function, from a plurality of distinct characteristics having defined associations with a respective plurality of distinct control functions.

6. The aerosol delivery device of claim 1 further comprising:

a motion sensor configured to detect motion and thereby a manipulation of the aerosol delivery device, wherein the processing circuitry is further configured to cause the aerosol delivery device to at least:

determine a characteristic of the manipulation;

determine whether the characteristic of the manipulation has a defined association with a second control function; and perform the second control function when the characteristic of the manipulation does have the defined association with the second control function, in response to the manipulation.

7. The aerosol delivery device of claim 6, wherein the processing circuitry comprises a database with a library of control functions including the control function and second control function, and respective associated input characteristics including the characteristic of the puff input and the characteristic of the manipulation, and wherein the processing circuitry is configured to determine the control function and the second control function from the database.

8. An aerosol delivery device comprising:

a puff sensor configured to detect a puff input to the aerosol delivery device;

a battery; and processing circuitry coupled with the puff sensor, wherein the processing circuitry is configured to cause the aerosol delivery device to at least:

determine a characteristic of the puff input that is a single puff on the aerosol delivery device, the characteristic of the puff input including a duration or force of the single puff;

determine the characteristic of the puff input has a defined association with a control function;

cause the aerosol delivery device to both form an inhalable substance from an aerosol precursor composition, and perform the control function when the characteristic of the puff input does have the defined association with the control function, in response to the puff input, the processing circuitry configured to cause the aerosol delivery device to form the inhalable substance without the control function being performed when the characteristic of the puff input does not have the defined association with the control function; and cause the aerosol delivery device to provide an indication of a charge level of the battery in response to the puff input.

9. The aerosol delivery device of claim 8, wherein the processing circuitry configured to cause the aerosol delivery device to perform the control function includes the processing circuitry configured to cause the aerosol delivery device to provide an indication of a level of aerosol precursor composition remaining in a cartridge operatively engaged with the aerosol delivery device in response to the puff input.

10. The aerosol delivery device of claim 8, wherein the processing circuitry configured to cause the aerosol delivery device to perform the control function includes the processing circuitry configured to cause the aerosol delivery device to modify a configuration setting of the aerosol delivery device.

11. The aerosol delivery device of claim 10, wherein the processing circuitry configured to cause the aerosol delivery device to modify the configuration setting includes the processing circuitry configured to cause the aerosol delivery device to modify one or more of a configuration setting for a light emitting diode (LED) indicator, a haptic feedback configuration, a heating profile configuration, an aerosol precursor composition vaporization setting, a puff control setting, or a battery management setting.

12. The aerosol delivery device of claim 8, wherein the processing circuitry is configured to cause the aerosol delivery device to determine whether the characteristic of the puff input has the defined association with the control function, from a plurality of distinct characteristics having defined associations with a respective plurality of distinct control functions.

13. The aerosol delivery device of claim 8 further comprising:

a motion sensor configured to detect motion and thereby a manipulation of the aerosol delivery device, wherein the processing circuitry is further configured to cause the aerosol delivery device to at least:

determine a characteristic of the manipulation;

determine whether the characteristic of the manipulation has a defined association with a second control function; and perform the second control function when the characteristic of the manipulation does have the defined association with the second control function, in response to the manipulation.

14. The aerosol delivery device of claim 13, wherein the processing circuitry comprises a database with a library of control functions including the control function and second control function, and respective associated input characteristics including the characteristic of the puff input and the characteristic of the manipulation, and wherein the processing circuitry is configured to determine the control function and the second control function from the database.

* * * * *